US009910382B1

(12) United States Patent
Barry et al.

(10) Patent No.: US 9,910,382 B1
(45) Date of Patent: Mar. 6, 2018

(54) CAPACITIVE TONER LEVEL SENSOR

(71) Applicant: LEXMARK INTERNATIONAL, INC., Lexington, KY (US)

(72) Inventors: Raymond Jay Barry, Lexington, KY (US); William George Goff, III, Lexington, KY (US); Jason Carl True, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/259,522

(22) Filed: Sep. 8, 2016

(51) Int. Cl.
*G03G 15/08* (2006.01)
*G03G 21/16* (2006.01)

(52) U.S. Cl.
CPC ..... *G03G 15/0865* (2013.01); *G03G 21/1652* (2013.01)

(58) Field of Classification Search
USPC ..... 399/24, 111, 120, 252, 258, 262, 263
See application file for complete search history.

(56) References Cited

U.S. PATENT DOCUMENTS 5,987,269 A * 11/1999 Allen ..... G03G 15/086 399/27
7,555,231 B2 6/2009 Etter et al.
8,116,641 B2 * 2/2012 Soutome ..... G03G 15/0856 399/27
8,718,496 B2 5/2014 Barry et al.
9,109,939 B2 8/2015 Barry et al.
9,317,005 B2 * 4/2016 Monde ..... G03G 15/086
9,395,645 B2 7/2016 Barry et al.

* cited by examiner

*Primary Examiner* — Hoan Tran

(57) ABSTRACT

A toner container according to one example embodiment includes a housing having a reservoir for holding toner. A rotatable shaft is positioned in the reservoir and has a rotational axis. A toner agitator is rotatably coupled to the rotatable shaft. A first electrical conductor and a second electrical conductor are positioned on the housing. The first electrical conductor and the second electrical conductor form a capacitor having a capacitance that changes in response to a change in an amount of toner in the reservoir between the first electrical conductor and the second electrical conductor. The first electrical conductor includes a rod positioned in the reservoir at the rotational axis of the rotatable shaft and extending along the rotational axis of the rotatable shaft.

22 Claims, 9 Drawing Sheets

CAPACITIVE TONER LEVEL SENSOR

CROSS REFERENCES TO RELATED APPLICATIONS

None.

BACKGROUND

1. Field of the Disclosure

The present disclosure relates generally to electrophotographic image forming devices and more particularly to a capacitive toner level sensor for an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units installed in the image forming device. As these replaceable units run out of toner, the units must be replaced or refilled in order to continue printing. Further, residual or waste toner generated during the printing process is also typically stored in a replaceable unit installed in the image forming device. When the replaceable unit holding waste toner fills, it must be emptied or replaced in order to accommodate additional waste toner. As a result, it is desired to measure the amount of toner remaining in these units in order to warn the user that a replaceable unit storing the toner supply is near an empty state or that a replaceable unit storing waste toner is near a full state. Accordingly, a system for measuring the amount of toner remaining in a replaceable unit of an image forming device is desired.

SUMMARY

A toner container according to one example embodiment includes a housing having a reservoir for holding toner. A rotatable shaft is positioned in the reservoir and has a rotational axis. A toner agitator is rotatably coupled to the rotatable shaft. A first electrical conductor and a second electrical conductor are positioned on the housing. The first electrical conductor and the second electrical conductor form a capacitor having a capacitance that changes in response to a change in an amount of toner in the reservoir between the first electrical conductor and the second electrical conductor. The first electrical conductor includes a rod positioned in the reservoir at the rotational axis of the rotatable shaft and extending along the rotational axis of the rotatable shaft.

A toner container according to another example embodiment includes a housing having a cylindrical reservoir for holding toner. The reservoir has a generally circular cross-sectional shape. A first electrical conductor and a second electrical conductor are positioned on the housing. The first electrical conductor and the second electrical conductor form a capacitor having a capacitance that changes in response to a change in an amount of toner in the reservoir between the first electrical conductor and the second electrical conductor. The first electrical conductor includes an arc-shaped sheet that extends along a wall of the housing that forms the reservoir. The arc-shaped sheet curves along at least a portion of the generally circular cross-sectional shape of the reservoir.

A toner container according to another example embodiment includes a housing having a reservoir for holding toner. A first electrical conductor and a second electrical conductor are positioned on the housing. The first electrical conductor and the second electrical conductor form a capacitor having a capacitance that changes in response to a change in an amount of toner in the reservoir between the first electrical conductor and the second electrical conductor. The first electrical conductor includes a rod having a longitudinal axis. The second electrical conductor includes a sheet that extends along the longitudinal axis of the rod and is spaced from the rod.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
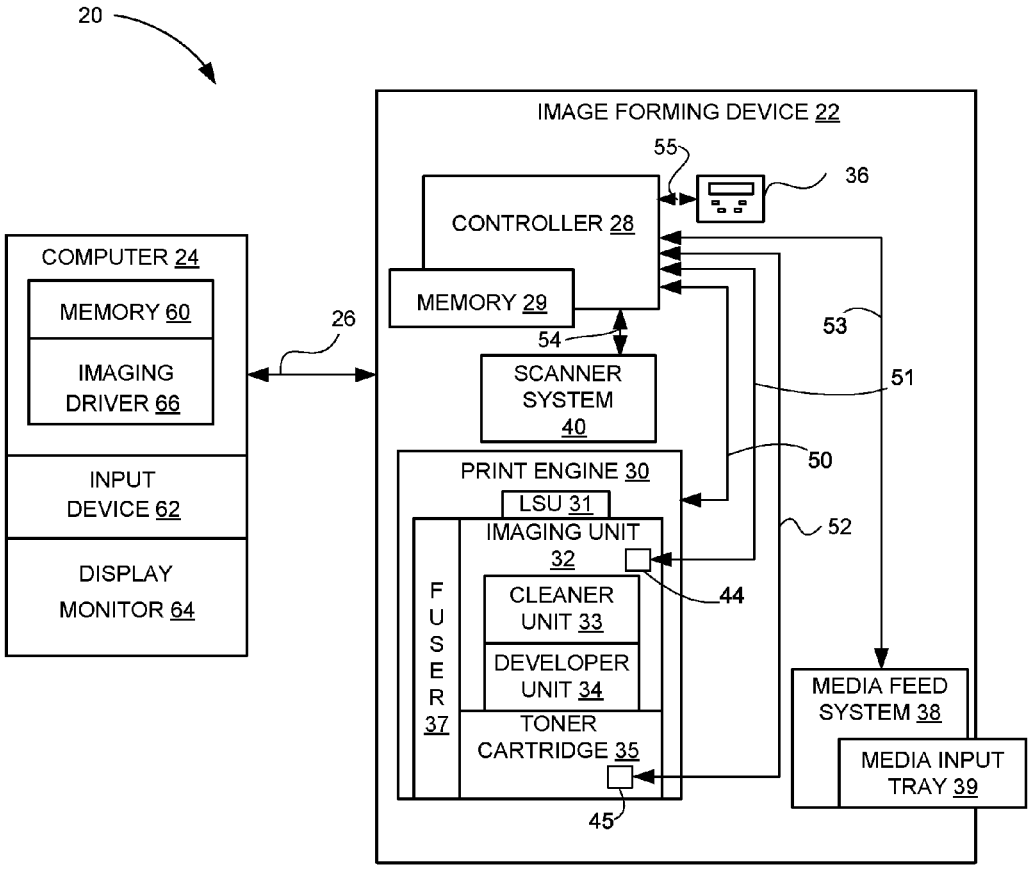
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29. The processor may include one or more integrated circuits in the form of a microprocessor or central processing unit and may be formed as one or more Application-specific integrated circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 35, imaging unit 32, and a fuser 37, all mounted within image forming device 22. Imaging unit 32 is removably mounted in image forming device 22 and includes a developer unit 34 that houses a toner sump and a toner delivery system. In one embodiment, the toner delivery system utilizes what is commonly referred to as a single component development system. In this embodiment, the toner delivery system includes a toner adder roll that provides toner from the toner sump to a developer roll. A doctor blade provides a metered uniform layer of toner on the surface of the developer roll. In another embodiment, the toner delivery system utilizes what is commonly referred to as a dual component development system. In this embodiment, toner in the toner sump of developer unit 34 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 34 includes a magnetic roll that attracts the magnetic carrier beads having toner thereon to the magnetic roll through the use of magnetic fields.

Imaging unit 32 also includes a cleaner unit 33 that houses a photoconductive drum and a waste toner removal system. Toner cartridge 35 is removably mounted in image forming device 22 in a mating relationship with developer unit 34 of imaging unit 32. An outlet port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll (in the case of a single component development system) or by the magnetic roll (in the case of a dual component development system) to create a toned image. The toned image is then transferred to a media sheet received by imaging unit 32 from media input tray 39 for printing. Toner may be transferred directly to the media sheet by the photoconductive drum or by an intermediate transfer member that receives the toner from the photoconductive drum.

Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
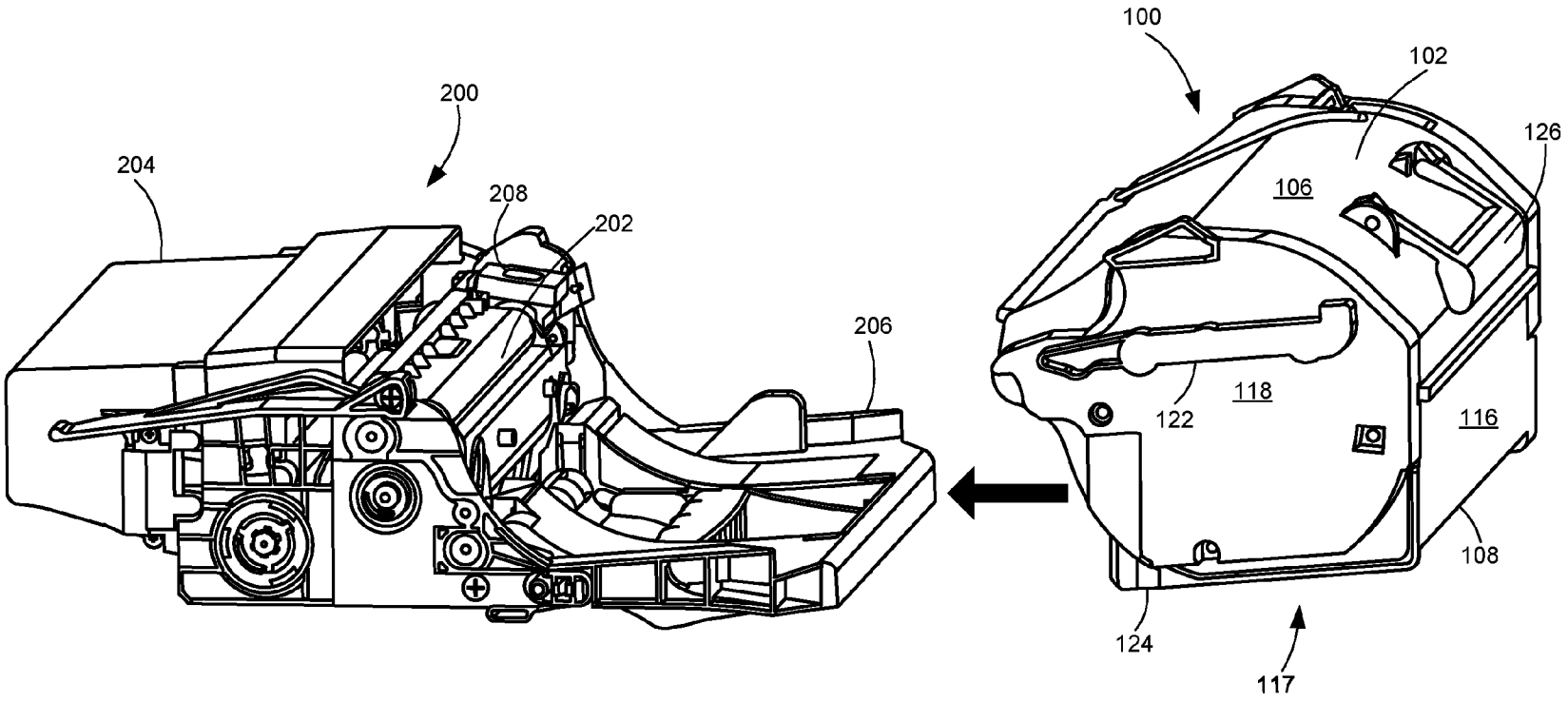
FIG. 2 is a perspective view of a toner cartridge and an imaging unit according to one example embodiment.
Figure 3:
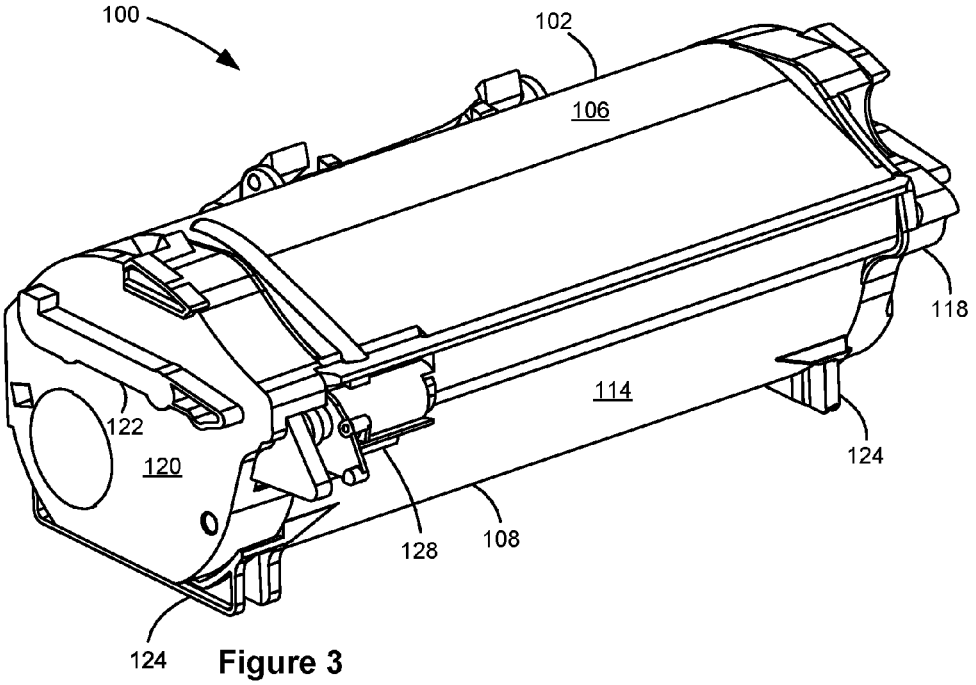
FIGS. 3 and 4 are additional perspective views of the toner cartridge shown in FIG. 2.
Figure 4:
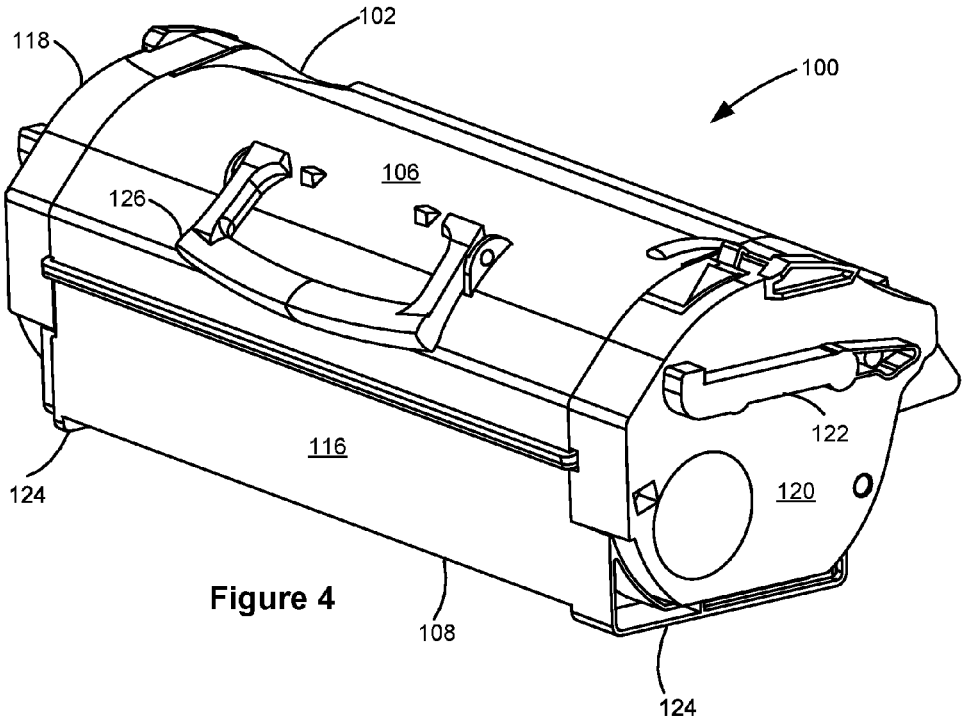

Referring now to FIG. 2, a toner cartridge 100 and an imaging unit 200 are shown according to one example embodiment. Imaging unit 200 includes a developer unit 202 and a cleaner unit 204 mounted on a common frame 206. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow shown in FIG. 2. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 may include a top or lid 106 mounted on a base 108. Base 108 includes first and second side walls 110, 112 connected to adjoining front and rear walls 114, 116 and a bottom 117. First and second end caps 118, 120 may be mounted to side walls 110, 112, respectively, and may include guides 122 to assist the insertion of toner cartridge 100 into image forming device 22 for mating with developer unit 202. Legs 124 may also be provided on bottom 117 of base 108 or end caps 118, 120 to assist with the insertion of toner cartridge 100 into image forming device 22. A handle 126 may be provided on top 106 or base 108 of toner cartridge 100 to assist with insertion and removal of toner cartridge 100 from imaging unit 200 and image forming device 22. An outlet port 128 is positioned on front wall 114 of toner cartridge 100 for exiting toner from toner cartridge 100.

Figure 5:
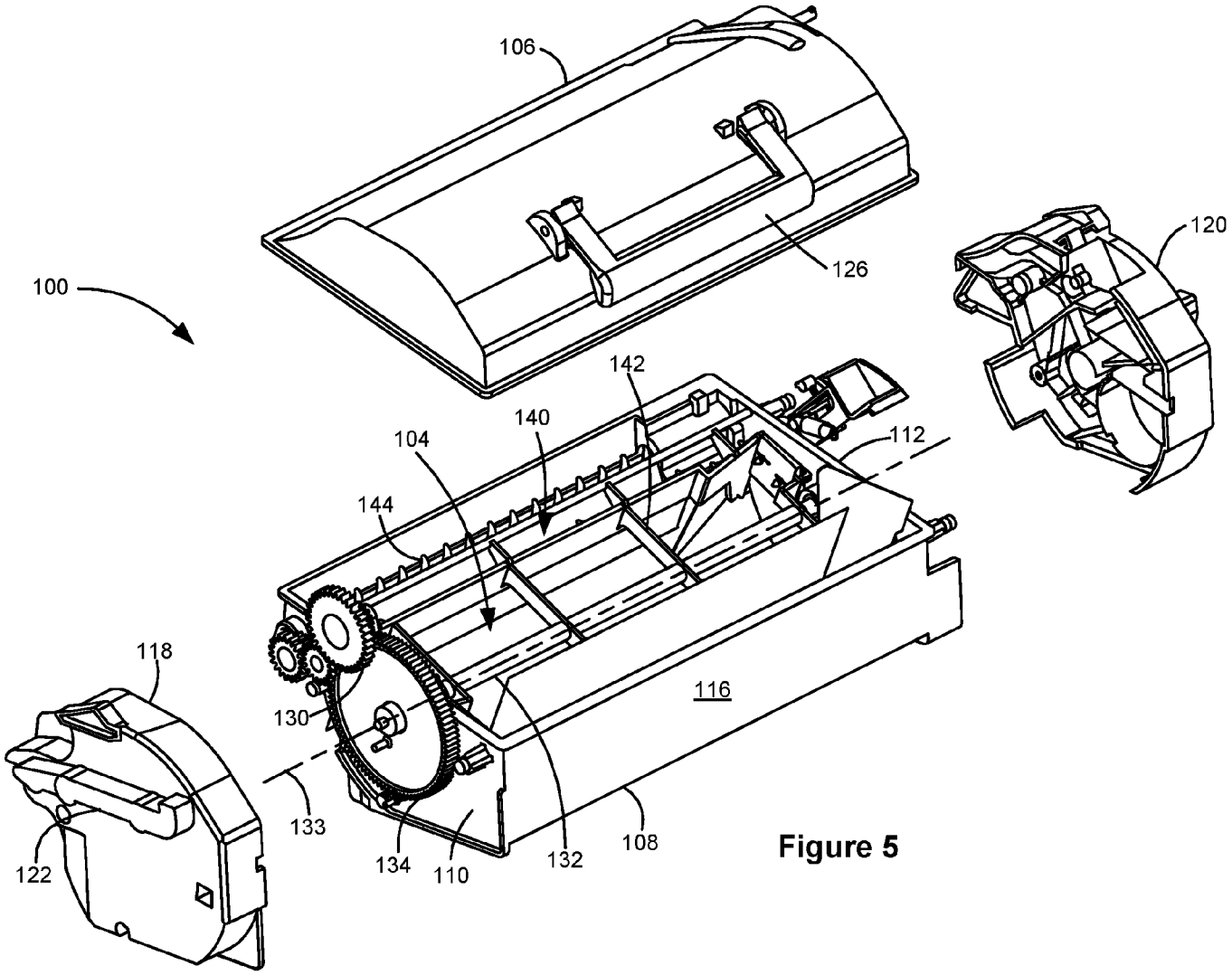
FIG. 5 is an exploded view of the toner cartridge shown in FIGS. 2-4 showing a reservoir for holding toner therein.

With reference to FIG. 5, in the example embodiment illustrated, various drive gears are housed within a space formed between end cap 118 and side wall 110. A main interface gear 130 engages with a drive system in image forming device 22 that provides torque to main interface gear 130. The drive system in image forming device 22 includes a drive motor and a drive transmission from the drive motor to a drive gear that mates with main interface gear 130 when toner cartridge 100 is installed in image forming device 22. A drive shaft 132 is rotatably positioned within toner reservoir 104 with first and second ends of drive shaft 132 extending through aligned openings in side walls 110, 112, respectively. Drive shaft 132 is rotatable about a rotational axis 133. A drive gear 134 is provided on the first end of drive shaft 132 that engages with main interface gear 130 either directly or via one or more intermediate gears. Bushings may be provided on each end of drive shaft 132 where it passes through side walls 110, 112. A toner agitator assembly 140 is rotatably coupled to drive shaft 132. As drive shaft 132 rotates, toner agitator assembly 140 stirs and mixes the toner in reservoir 104. Toner agitator assembly 140 may include any suitable form or combination of toner mixer(s), conveyor(s), etc. rotatably coupled to drive shaft 132. For example, toner agitator assembly 140 may include agitators and/or paddles extending from drive shaft 132 or an auger or other form of conveyor formed on drive shaft 132. In the example embodiment illustrated, toner agitator assembly 140 includes a series of paddles 142 extending from drive shaft 132 that deliver toner to an auger 144. Auger 144 is rotatably coupled to drive shaft 132 and moves toner to outlet port 128, which delivers the toner to a corresponding entrance port 208 of developer unit 202 (FIG. 2).

Figure 6:
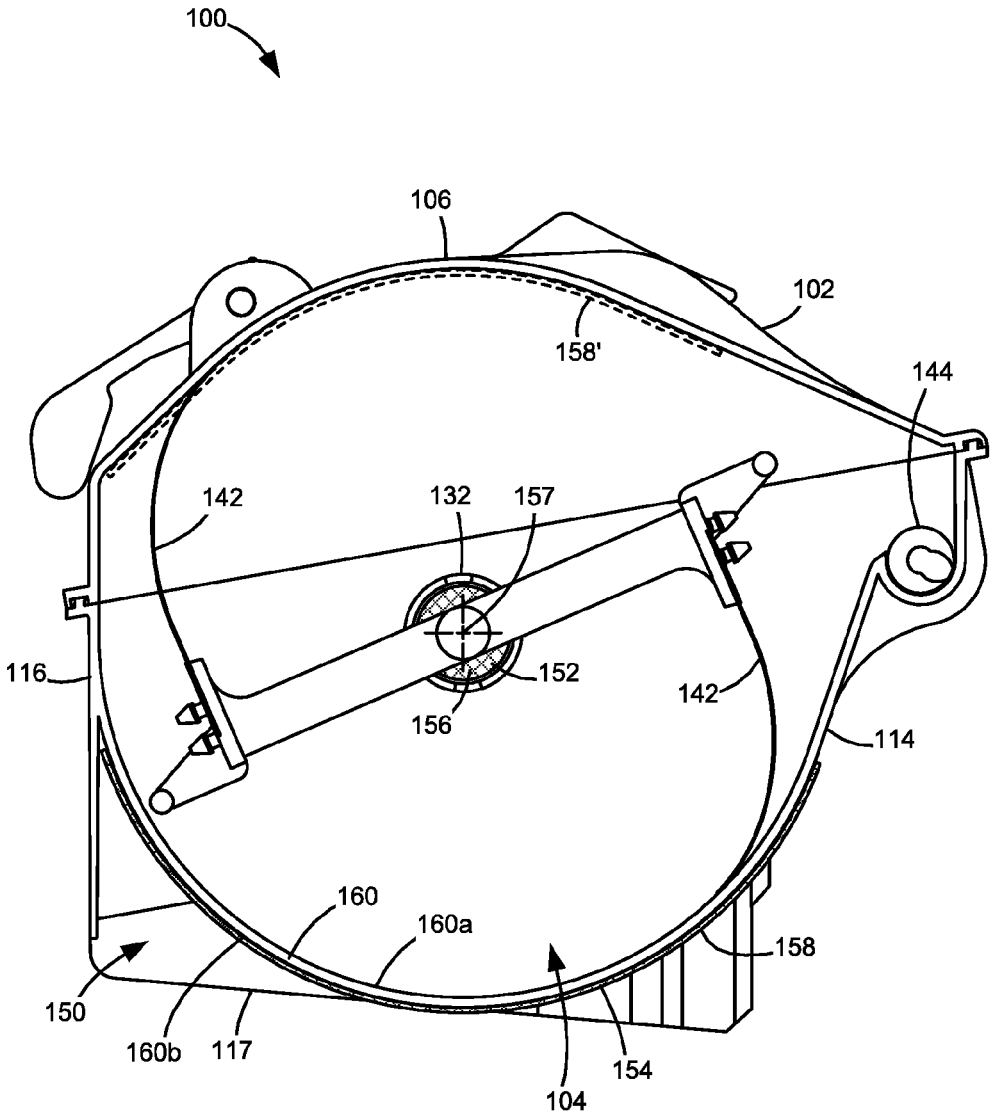
FIG. 6 is a cross-sectional view of the toner cartridge shown in FIGS. 2-5 having a capacitive toner level sensor according to one example embodiment.

With reference to FIG. 6, toner cartridge 100 includes a capacitive toner level sensor 150 for detecting the toner level in reservoir 104. Toner level sensor 150 includes a capacitor formed by a first conductor 152 and at least one additional conductor 154 spaced from conductor 152. Each conductor 152, 154 is composed of an electrically conductive material such as metal. The first conductor 152 is used to sense a capacitance value indicative of the toner level in reservoir 104 and the other conductor(s) 154 are driven by a voltage during a capacitive sensing operation. Where more than one additional conductor 154 is present, in some embodiments, the conductors 154 are electrically coupled to each other and driven by a common signal source, such as an AC voltage signal source. In other embodiments where more than one additional conductor 154 is present, the conductors 154 are electrically insulated from each other and driven by separate voltage signal sources. The capacitor may be characterized by an inherent capacitance that varies in response to the amount of toner existing between conductor 152 and conductor(s) 154. As toner is depleted from reservoir 104, air fills in the voids left by displaced toner between the respective conductors 152, 154. The dielectric constant of air is generally different from the dielectric constant of toner. As a result, changes in the capacitance of the capacitor occur due to a change in the composite dielectric constant of the substance between the respective conductors 152, 154 such that changes in the capacitance of the capacitor indicate changes in the toner level in reservoir 104. Conductor 152 may be electrically coupled to sensing circuitry (not shown) that receives electrical signals appearing on conductor 152 and determines the capacitance of the capacitor. The sensing circuitry may be located in processing circuitry 45 of toner cartridge 100, controller 28, a combination thereof or elsewhere within imaging system 20.

With reference to FIGS. 5 and 6, in the example embodiment illustrated, conductor 152 is formed by a rod 156 positioned in reservoir 104 at the rotational axis 133 of drive shaft 132. In this embodiment, conductor 152 extends laterally across reservoir 104, along rotational axis 133. In the example embodiment illustrated, rod 156 is fixed and runs from side wall 110 to side wall 112 through the center of drive shaft 132. In this embodiment, drive shaft 132 is hollow at its center such that drive shaft 132 is rotatable around rod 156 and rod 156 does not rotate relative to housing 102. In the example embodiment illustrated, rod 156 has a circular cross section; however, rod 156 may have any suitable cross-sectional shape as desired, such as, for example, square, octagonal, etc. Rod 156 may be hollow or solid throughout. In other embodiments, all or a portion of drive shaft 132 is electrically conductive forming rod 156 such that conductor 152 rotates relative to housing 102. However, it will be appreciated that it may be more difficult to maintain reliable electrical contact with a rotating conductor 152 than a fixed conductor 152.

In the embodiment illustrated, conductor 154 includes a curved sheet 158 positioned along a wall 160 of housing 102 forming reservoir 104. Sheet 158 may be positioned along an inner surface 160*a* of wall 160, inside of reservoir 104, or along an outer surface 160*b* of wall 160, outside of reservoir 104. Positioning sheet 158 along inner surface 160*a* may provide more accurate toner level sensing but positioning sheet 158 along outer surface 160*b* may provide assembly advantages. In the example embodiment illustrated, sheet 158 is positioned along an underside of reservoir 104, underneath rod 156. The positioning of sheet 158 along the underside of reservoir 104 may allow for more accurate detection of the toner level in reservoir 104 as the toner level approaches an empty condition. In other embodiments, sheet 158 is positioned along other portions of reservoir 104, such as, for example, the front, rear and/or top of reservoir 104, instead of or in addition to the underside of reservoir 104. Sheet 158 extends along a longitudinal axis 157 of rod 156. In the embodiment illustrated, sheet 158 is concave with respect to rod 156 in a circumferential direction with respect to longitudinal axis 157. In the example embodiment illustrated, sheet 158 forms an arc that spans roughly 140 degrees around rod 156 in the lower half of reservoir 104. However, sheet 158 may span less than 140 degrees or as much as 360 degrees around rod 156 as desired. Sheet 158 may have a fixed radius of curvature or the radius of curvature of sheet 158 may vary. The radius of curvature of sheet 158 may be centered about longitudinal axis 157 or another point, preferably near longitudinal axis 157. The curvature of sheet 158 may be uniform axially along longitudinal axis 157 or the curvature of sheet 158 may vary axially along longitudinal axis 157. While the example embodiment illustrated includes a curved sheet 158, other shapes may be utilized as desired, such as, for example, a stepped or multi-faceted sheet 158. Further, while the example embodiment illustrated includes a continuous sheet 158, sheet 158 may include cutouts, windows, extensions, segments, etc.

While the example embodiments discussed above include rod 156 forming conductor 152 used to sense a capacitance value and sheet 158 forming the additional conductor 154, this configuration may be reversed as desired such that sheet 158 forms conductor 152 used to sense a capacitance value and rod 156 forms the conductor 154.

Further, some embodiments include more than one sheet 158. For example, FIG. 6 shows a second sheet 158' in broken line. In the example embodiment illustrated, sheet 158' is curved in a manner concave to rod 156 in a circumferential direction with respect to longitudinal axis 157 and is positioned along the top of reservoir 104. Where toner level sensor 150 includes both sheet 158 and sheet 158', rod 156 and sheets 158, 158' form two parallel capacitors with rod 156 serving as a common conductor of the two capacitors. Further, toner level sensor 150 may include more than two sheets 158, 158' as desired.

In the example embodiment illustrated, reservoir 104 is cylindrical with a generally circular cross-sectional shape, which is preferred in order to reduce the amount of unused toner in reservoir 104. For example, if the cross-sectional shape of reservoir 104 includes corners, indentations or offset pockets, it may be difficult to move toner from those areas of reservoir 104 to outlet port 128. Positioning rod 156 along the rotational axis 133 of drive shaft 132 and sheet 158 along a curved wall 160 that forms reservoir 104 allows for the detection of the toner level in reservoir 104 without restricting the operation of toner agitator assembly 140. If, on the other hand, rod 156 was replaced with an electrically conductive plate extending along a central portion of reservoir 104, the plate would tend to interfere with or limit the reach of paddles 142. Further, if rod 156 was omitted and instead sheets 158 and 158' served as conductors 152 and 154, respectively, the capacitance measured would be dominated by the composite dielectric constant of the substance present between sheets 158 and 158' at their frontmost and rearmost ends, where sheets 158 and 158' are closest to each other, rather than along the entire arc of sheets 158, 158' as measured with rod 156 and sheet(s) 158, 158'.

Figure 7:
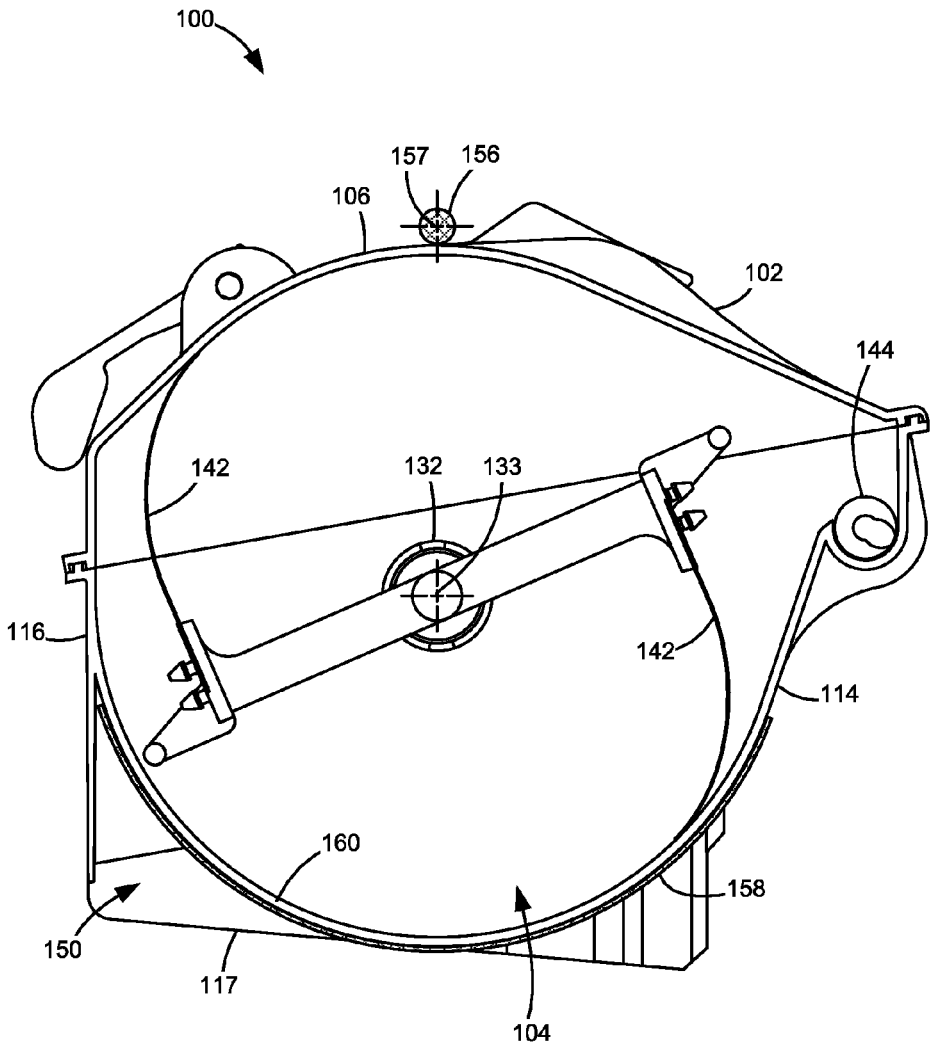
FIG. 7 is a cross-sectional view of the toner cartridge shown in FIGS. 2-5 having a capacitive toner level sensor according to another example embodiment.

While the example embodiment illustrated in FIG. 6 shows rod 156 positioned at rotational axis 133 of drive shaft 132, rod 156 may be positioned elsewhere on housing 102, either within reservoir 104 or outside of reservoir 104, as desired. For example, FIG. 7 shows rod 156 positioned outside of reservoir 104, in a fixed position at the top 106 of housing 102. In the embodiment illustrated, sheet 158 is in the same position as shown in FIG. 6; however, the position and configuration of sheet 158 may vary as discussed above.

Figure 8:
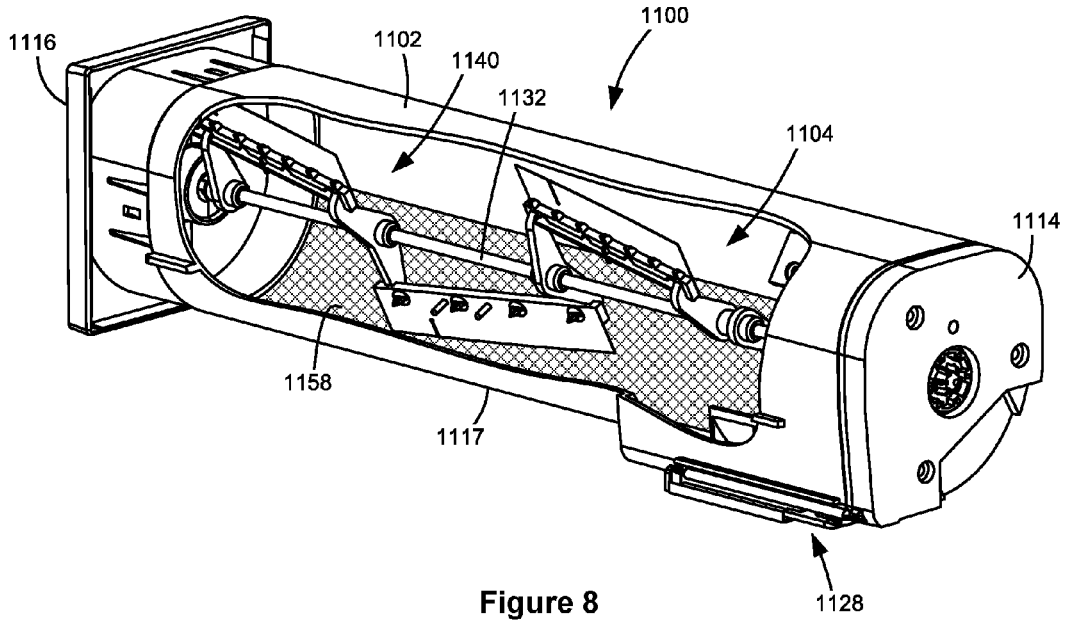
FIGS. 8 and 9 are a perspective view and a cross-sectional view, respectively, of a toner cartridge according to another example embodiment having a capacitive toner level sensor.
Figure 9:
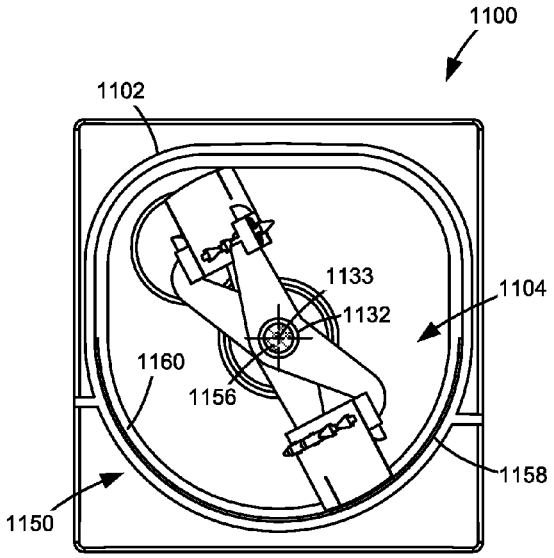

Toner cartridge 100 is not limited to the example embodiment illustrated and may take many different configurations. For example, FIGS. 8 and 9 show a toner cartridge 1100 according to another example embodiment with a portion of its housing 1102 removed to show a toner reservoir 1104. In this embodiment, housing 1102 extends in an elongated manner between a front end 1114 and a rear end 1116. Housing 1102 slides lengthwise into the image forming device. An outlet port 1128 is positioned on the bottom 1117 of housing 1102, near front end 1114. Toner cartridge 1100 includes a drive shaft 1132 that extends along a longitudinal dimension of housing 1102 within toner reservoir 1104. A toner agitator assembly 1140 is rotatably coupled to drive shaft 1132 to mix the toner in reservoir 1104 and move the toner toward outlet port 1128. A rod 1156 at the rotational axis 1133 of drive shaft 1132 forms a first conductor of a capacitive toner level sensor 1150. As discussed above, rod 1156 may be rotatable or fixed relative to housing 1102. A curved sheet 1158 positioned along a wall 1160 forming reservoir 1104 forms a second conductor of capacitive toner level sensor 1150.

Figure 10:
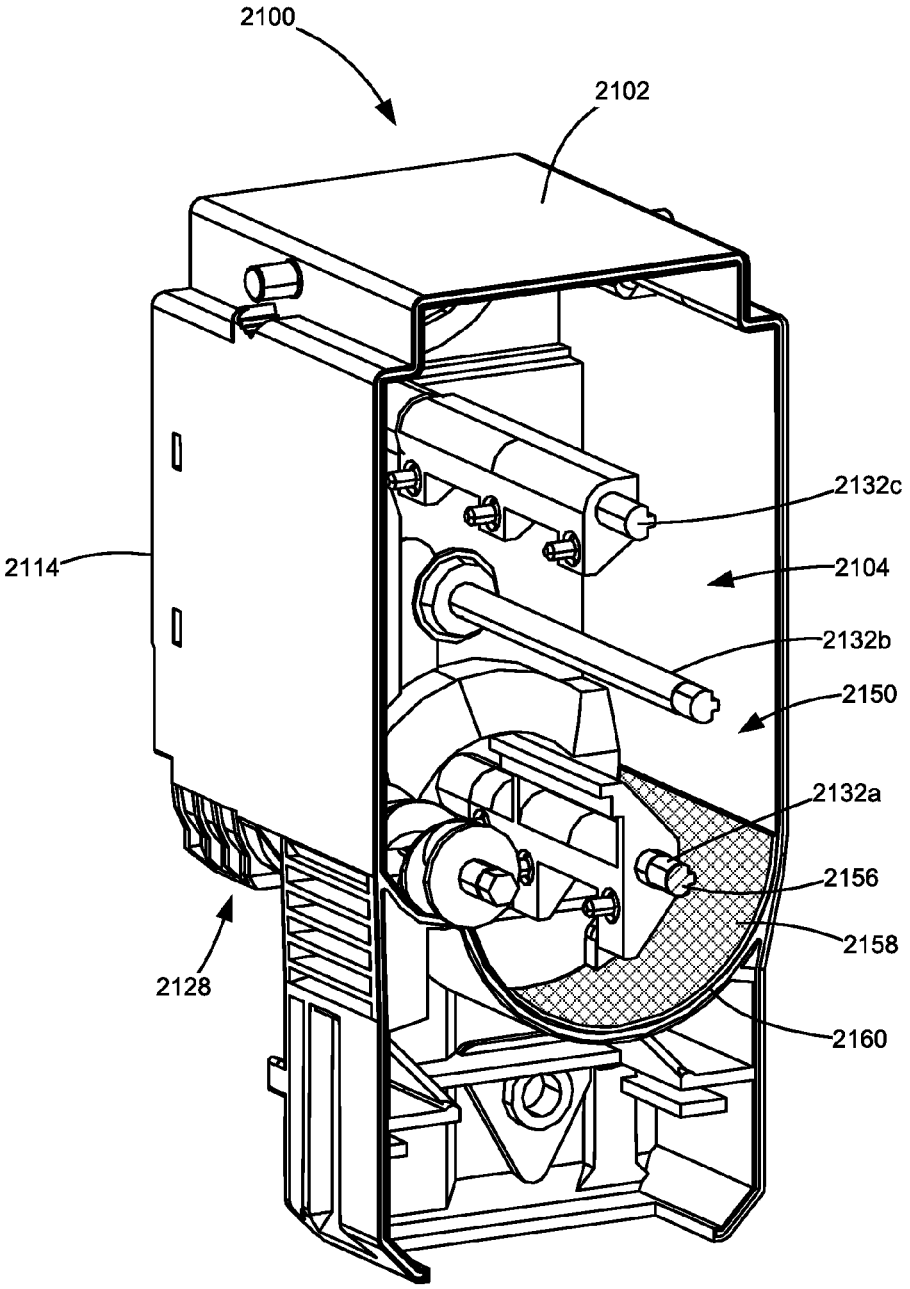
FIG. 10 is a cross-sectional view of a toner cartridge according to another example embodiment having a capacitive toner level sensor.

FIG. 10 shows a toner cartridge 2100 according to another example embodiment with a portion of its housing 2102 removed to show a toner reservoir 2104. In this embodiment, toner cartridge 2100 includes a tall, narrow box-shaped housing 2102 that inserts vertically downward into the image forming device. An outlet port 2128 is positioned on the front 2114 of housing 2102. Toner cartridge 2100 includes a series of drive shafts 2132*a*, 2132*b*, 2132*c* within toner reservoir 2104. Drive shafts 2132*a*, 2132*b*, 2132*c* include various toner agitators rotatable therewith that mix the toner in reservoir 2104 and move the toner toward outlet port 2128. A rod 2156 at the rotational axis of one of the drive shafts 2132*a*, 2132*b*, 2132*c* forms a first conductor of a capacitive toner level sensor 2150. As discussed above, rod 2156 may be rotatable or fixed relative to housing 2102. A curved sheet 2158 positioned along a wall 2160 forming reservoir 2104 forms a second conductor of capacitive toner level sensor 2150.

Figure 11:
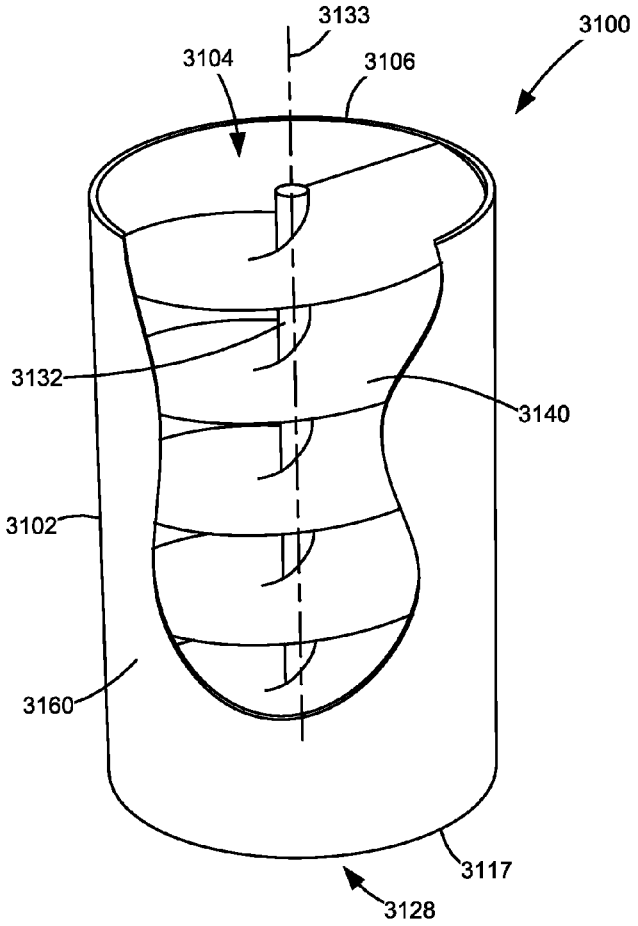
FIGS. 11 and 12 are a perspective view and a cross-sectional view, respectively, of a toner cartridge according to another example embodiment having a capacitive toner level sensor.
Figure 12:
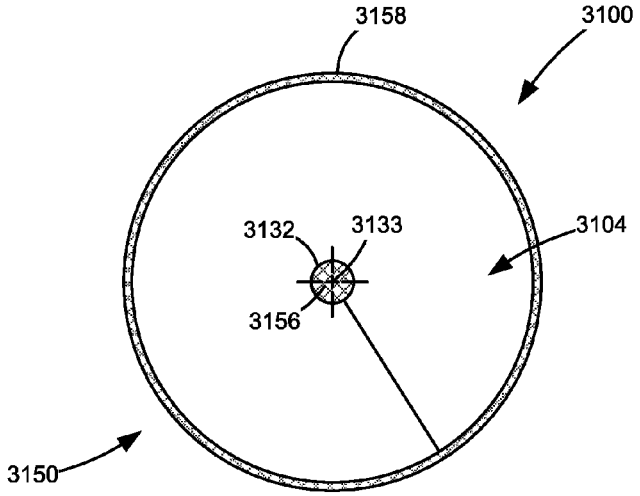

FIGS. 11 and 12 show a toner cartridge 3100 according to another example embodiment. A portion of a housing 3102 of toner cartridge 3100 is omitted from FIG. 11 to show a toner reservoir 3104. In this embodiment, housing 3102 extends in an elongated manner between a top end 3106 and a bottom end 3117 of toner cartridge 3100. An outlet port 3128 is positioned on the bottom 3117 of housing 3102. Toner cartridge 3100 includes a drive shaft 3132 that extends vertically along housing 3102 within toner reservoir 3104. A toner agitator assembly 3140 is rotatably coupled to drive shaft 3132 to mix the toner in reservoir 3104 and move the toner toward outlet port 3128. A rod 3156 at the rotational axis 3133 of drive shaft 3132 forms a first conductor of a capacitive toner level sensor 3150. As discussed above, rod 3156 may be rotatable or fixed relative to housing 3102. A cylindrical sheet 3158 extending vertically along a wall 3160 forming reservoir 3104 forms a second conductor of capacitive toner level sensor 3150. In the example embodiment illustrated, sheet 3158 spans 360 degrees around rod 3156; however, sheet 3158 may span less than 360 degrees as desired.

Although the example embodiments illustrated include a capacitive toner level sensor positioned in the reservoir of a toner cartridge, it will be appreciated that a capacitive toner level sensor may be positioned in any toner reservoir, such as, for example, the toner sump of developer unit 202 or a reservoir for storing waste toner removed by the waste toner removal system of cleaner unit 204. Further, although the example embodiments include a pair of replaceable units in the form of a toner cartridge and an imaging unit, it will be appreciated that the replaceable unit(s) of the image forming device may employ any suitable configuration as desired. For example, in one embodiment, the main toner supply for the image forming device, the developer unit, and the cleaner unit are housed in one replaceable unit. In another embodiment, the main toner supply for the image forming device and the developer unit are provided in a first replaceable unit and the cleaner unit is provided in a second replaceable unit. Further, although the example image forming device 22 discussed above includes one toner cartridge and corresponding imaging unit, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner container, comprising:

a housing having a reservoir for holding toner;

a rotatable shaft positioned in the reservoir and having a rotational axis, a toner agitator is rotatably coupled to the rotatable shaft; and a first electrical conductor and a second electrical conductor positioned on the housing, the first electrical conductor and the second electrical conductor forming a capacitor having a capacitance that changes in response to a change in an amount of toner in the reservoir between the first electrical conductor and the second electrical conductor, the first electrical conductor includes a rod positioned in the reservoir at the rotational axis of the rotatable shaft and extending along the rotational axis of the rotatable shaft.

2. The toner container of claim 1, wherein the second electrical conductor includes a curved sheet that extends along the rotational axis of the rotatable shaft and is concave with respect to the rod in a circumferential direction with respect to the rotational axis of the rotatable shaft.

3. The toner container of claim 2, wherein the curved sheet is positioned along a wall of the housing that forms the reservoir.

4. The toner container of claim 3, wherein the curved sheet is positioned along an inner surface of the wall of the housing that forms the reservoir.

5. The toner container of claim 2, wherein at least a portion of the curved sheet is positioned along an underside of the reservoir, underneath the rod.

6. The toner container of claim 2, wherein a radius of curvature of the curved sheet is fixed.

7. The toner container of claim 2, wherein a radius of curvature of the curved sheet is centered about the rotational axis of the rotatable shaft.

8. The toner container of claim 1, wherein the rod is fixed relative to the housing and positioned inside of the rotatable shaft.

9. A toner container, comprising:

a housing having a cylindrical reservoir for holding toner, the reservoir having a generally circular cross-sectional shape; and a first electrical conductor and a second electrical conductor positioned on the housing, the first electrical conductor and the second electrical conductor forming a capacitor having a capacitance that changes in response to a change in an amount of toner in the reservoir between the first electrical conductor and the second electrical conductor, the first electrical conductor includes an arc-shaped sheet that extends along a wall of the housing that forms the reservoir, the arc-shaped sheet curves along at least a portion of the generally circular cross-sectional shape of the reservoir.

10. The toner container of claim 9, wherein the second electrical conductor includes a rod, the arc-shaped sheet is concave with respect to the rod.

11. The toner container of claim 10, further comprising a rotatable component positioned in the reservoir and having a rotational axis, wherein the rod is positioned in the reservoir at the rotational axis of the rotatable component and extends along the rotational axis of the rotatable component.

12. The toner container of claim 10, wherein the rod includes a longitudinal axis and the arc-shaped sheet extends along the longitudinal axis of the rod and is concave with respect to the rod in a circumferential direction with respect to the longitudinal axis of the rod.

13. The toner container of claim 10, wherein the rod includes a longitudinal axis and a radius of curvature of the arc-shaped sheet is centered about the longitudinal axis of the rod.

14. The toner container of claim 9, wherein the arc-shaped sheet is positioned along an inner surface of the wall of the housing that forms the reservoir.

15. The toner container of claim 9, wherein at least a portion of the arc-shaped sheet is positioned along an underside of the reservoir.

16. The toner container of claim 9, wherein a radius of curvature of the arc-shaped sheet is fixed.

17. A toner container, comprising:

a housing having a reservoir for holding toner; and a first electrical conductor and a second electrical conductor positioned on the housing, the first electrical conductor and the second electrical conductor forming a capacitor having a capacitance that changes in response to a change in an amount of toner in the reservoir between the first electrical conductor and the second electrical conductor, the first electrical conductor includes a rod having a longitudinal axis, the second electrical conductor includes a sheet that extends along the longitudinal axis of the rod and is spaced from the rod.

18. The toner container of claim 17, wherein the sheet is positioned along a wall of the housing that forms the reservoir.

19. The toner container of claim 18, wherein the sheet is positioned along an inner surface of the wall of the housing that forms the reservoir.

20. The toner container of claim 17, wherein the sheet is positioned along an underside of the reservoir, underneath the rod.

21. The toner container of claim 17, wherein the sheet is concave with respect to the rod.

22. The toner container of claim 17, further comprising a rotatable component positioned in the reservoir and having a rotational axis, wherein the rod is positioned in the reservoir at the rotational axis of the rotatable component and extends along the rotational axis of the rotatable shaft.

* * * * *